US008935864B2

(12) United States Patent
Halkyard et al.

(10) Patent No.: US 8,935,864 B2
(45) Date of Patent: Jan. 20, 2015

(54) SUBSEA EXCAVATION SYSTEMS AND METHODS

(75) Inventors: John Halkyard, Houston, TX (US); Eric Jackson, New Westminster (CA); Jonathan Bruce Machin, Neuilly-sur-Seine (FR)

(73) Assignee: Deep Reach Technology, Inc., Houston, TX (US)

( * ) Notice: Subject to any disclaimer, the term of this patent is extended or adjusted under 35 U.S.C. 154(b) by 3 days.

(21) Appl. No.: 13/816,867

(22) PCT Filed: Aug. 12, 2011

(86) PCT No.: PCT/US2011/047599

§ 371 (c)(1),
(2), (4) Date: Feb. 13, 2013

(87) PCT Pub. No.: WO2012/021813

PCT Pub. Date: Feb. 16, 2012

(65) Prior Publication Data

US 2013/0139415 A1 Jun. 6, 2013

Related U.S. Application Data

(60) Provisional application No. 61/373,627, filed on Aug. 13, 2010.

(51) Int. Cl.
*B63B 21/50* (2006.01)
*E02F 3/04* (2006.01)
(Continued)

(52) U.S. Cl.
CPC . *E02F 3/04* (2013.01); *E02F 3/905* (2013.01); *E02F 9/065* (2013.01)
USPC ..... 37/345

(58) Field of Classification Search
USPC ..... 37/307, 309, 313, 345; 299/1.5, 36.1
See application file for complete search history.

(56) References Cited

U.S. PATENT DOCUMENTS 3,171,219 A 3/1965 Kaufmann et al.
3,433,531 A * 3/1969 Koot et al. ..... 299/8
3,522,670 A * 8/1970 Todd et al. ..... 37/314
(Continued)

FOREIGN PATENT DOCUMENTS

EP 0837192 A1 4/1998
GB 2065751 A 7/1981
WO 9907949 2/1999

OTHER PUBLICATIONS

Clarke, Don et al., Vertical Mining Concept Study, Nautilus Minerals Inc., Nov. 2, 2009, John Halkyard and Associates, 96 pages.
(Continued)

*Primary Examiner* — Gary Hartmann
(74) *Attorney, Agent, or Firm* — Arnold, Knobloch & Saunders, L.L.P.; Jason A. Saunders

(57) ABSTRACT

Novel subsea excavation apparatus and methods that exert force between a subsea anchor point and an excavator using a subsea actuator. In some examples the subsea actuator is attached to an anchor point on the seabed and the excavator directly. In other examples, a guide frame is anchored to the seabed to provide anchor points fixed relative to the seabed and the subsea actuators are attached to the guide frame and the excavator. In further examples, the subsea actuators can be attached to the excavator through a carrier frame or other excavator guides rather than directly to the excavator.

15 Claims, 18 Drawing Sheets

(51) Int. Cl.
*E02F 3/90* (2006.01)
*E02F 9/06* (2006.01)

(56) References Cited

U.S. PATENT DOCUMENTS

| | | | | | |
|---|---|---|---|---|---|
| 3,731,975 | A | | 5/1973 | Lindelof | |
| 3,763,580 | A | * | 10/1973 | Kuntz, Jr. | 37/321 |
| 4,187,625 | A | | 2/1980 | Duval | |
| 4,214,842 | A | | 7/1980 | Franks | |
| 4,343,098 | A | | 8/1982 | Balligand et al. | |
| 4,685,742 | A | | 8/1987 | Moreau | |
| 4,812,079 | A | | 3/1989 | Johnson et al. | |
| 5,083,386 | A | | 1/1992 | Sloan | |
| 5,172,497 | A | | 12/1992 | Lemonds et al. | |
| 5,328,250 | A | | 7/1994 | Upright | |
| 5,921,713 | A | | 7/1999 | Gjessing et al. | |
| 5,931,235 | A | | 8/1999 | Weixler | |
| 6,003,952 | A | | 12/1999 | Smart et al. | |
| 6,041,527 | A | * | 3/2000 | Hostetler | 37/345 |
| 6,178,670 | B1 | | 1/2001 | Susman et al. | |
| 6,209,965 | B1 | | 4/2001 | Borns et al. | |
| 6,273,642 | B1 | | 8/2001 | Anderson | |
| 7,178,273 | B2 | | 2/2007 | Arzberger et al. | |
| 7,356,947 | B2 | | 4/2008 | Arzberger | |
| 7,367,143 | B2 | | 5/2008 | Stoetzer | |
| 7,647,712 | B2 | | 1/2010 | Tack | |
| 7,690,135 | B2 | | 4/2010 | Yu et al. | |
| 2009/0077835 | A1 | | 3/2009 | Yu et al. | |
| 2009/0284068 | A1 | | 11/2009 | Yu et al. | |
| 2010/0043256 | A1 | | 2/2010 | Susman et al. | |
| 2010/0083542 | A1 | * | 4/2010 | Powers | 37/324 |

OTHER PUBLICATIONS

International Patent Application No. PCT/US2011/047599, International Preliminary Report on Patentability and Written Opinion of the International Searching Authority, Form PCT/IB373, Form PCT/IB326 and Form PCT/ISA/237, Feb. 19, 2013, 8 pages.

International Patent Application No. PCT/US2011/047599, Notification of transmittal of the international search report and the Written Opinion of the International Searching Authority, or the Declaration, Form PCT/ISA/220, Form PCT/ISA/210 and Form PCT/ISA/237, Jan. 13, 2013, 9 pages.

U.S. Appl. No. 12/236,023, filed Sep. 23, 2008, 18 pages.

Written Opinion in related Singapore Application No. 2013010871, Jul. 8, 2014, 6 pages.

* cited by examiner

SUBSEA EXCAVATION SYSTEMS AND METHODS

TECHNICAL FIELD

The present invention relates generally to subsea excavation and mining.

BACKGROUND

Seabed excavation using equipment deployed from surface support vessels is well known. This general technique is routinely used by the marine dredging industry and subsea mining industry. Prior art in these fields is discussed below.

The dredging industry uses a range of excavation tools. The tools are generally suspended from surface support vessels by means of lowering equipment, such as winches or hydraulic elevators, which are located on the deck of the surface support vessel.

There are many different kinds of excavation tools and FIGS. 1 and 2 illustrate two of the most common, a trailer suction dredger and a cutter suction dredger respectively. However the common factor linking the tools in the prior art is that they all steered according to the required excavation trajectory using a combination of the one or both of: i) surface support vessel steering track, ii) winching across seabed using winches located on deck in combination with sheaves on or near the seabed.

The majority of marine dredging activity takes place in shallow water coastal waters. In deep water conditions (over 300 m water depth say) control over the excavation trajectory using these prior art techniques becomes increasingly difficult due to the practical limitations of distance between the surface support vessel and excavation tool on the seabed. In ultra-deep water conditions (over 1,000 m water depth say) efficient control using these techniques is likely to be almost impossible.

The subsea mining industry has developed alternative methods compared to the marine dredging industry. One of the drivers for new methods has been the requirement of this industry to operate in open water further from the coastline, and in rather greater water depths compared to the marine dredging industry. Some of the prior art in this field is discussed below.

Seabed drilling systems are used from drill ships by De Beers for diamond mining in South Africa and Namibia. These drills use the "reverse circulation" technique in which the excavated seabed material is drilled with a very large diameter drill bit and sucked up through the riser pipe 52. Apart from that aspect, the drilling technique is relatively conventional with a drill pipe suspended vertically from a deck-mounted derrick tower 39 and hoist 51. FIG. 3 illustrates this technique.

One of the major drawbacks of this technique is that drilling trajectory is purely vertical and there is no ability to steer the drill bit in a horizontal direction. As such the drill bit must be continually inserted, withdrawn following drilling, and then re-positioned on the seabed so the excavation takes place in a discrete and inefficient "cookie cutter" pattern. The circular nature of the drill bit makes it difficult to join the excavated holes together to make a contiguous excavation.

Another disadvantage is the difficulty in accurately controlling the position of the drill bit. If the mining operation is to be done efficiently, the location of the drill hole must be accurately controlled. Such accuracy can be difficult to achieve, particularly in deep water and in locations where the terrain is rugged (such as in most seabed massive sulphide ore deposits).

A further disadvantage in deep water is due to the fact that the power transfer to the drill bit is mechanically provided by the drill string. The downward force on the drill bit must be provided by the weight of the drill string, and this weight must be accurately controlled. Furthermore, the high torque requirements for the large diameter drill bit must also be provided through the drill string.

As an improvement over the drill ship method, De Beers have also developed a seabed crawler vehicle technique. This is illustrated in FIG. 4. In this technique the excavation tool 54 is mounted on a self propelled crawler vehicle 53 which can drive along the seabed 23. The surface support vessel 18 simultaneously following the track of the vehicle along the seabed 23. In this way the disadvantages of the drill ship technique described above are largely overcome. Firstly, it is possible to make the excavation in a continuous trajectory in the horizontal plane—with obvious advantages in excavation efficiency. Secondly, the location of the excavation tool 54 is controlled locally on the seabed by the location and orientation of the crawler vehicle 53. Thirdly, the crawler vehicle 53 provides its own power source, and it can easily control the interaction forces between the excavation tool and the rock being excavated.

An important distinction between different seabed crawlers is the number of degrees of freedom between the crawler vehicle 53 and the excavation tool 54. If the number of degrees of freedom is low, then the crawler vehicle 53 can make continuous horizontal cuts as it moves about the terrain. If the machine has enough degrees of freedom, it can sit in one place and make 3-dimensional cuts in its local vicinity. However, because a seabed crawler 53 must provide counter-balancing forces, it will be much heavier than a machine of similar production rate and have fewer degrees of freedom.

The seabed crawler vehicle technique has its own disadvantages. One of the key disadvantages being that the surface support vessel 18 is connected to the seabed crawler vehicle 53 by means of a flexible pipe 30 as opposed to a fixed steel pipe. Such flexible pipes are specialist products and extremely expensive to manufacture. Furthermore it is often difficult to adjust the length of this flexible pipe because such pipes are generally manufactured in fixed lengths. This can make it correspondingly more difficult to adjust the seabed crawler technique to account for varying water depths, when compared to techniques which use fixed steel pipes which can be routinely and cheaply made up as required in conventional multi joint lengths.

Another disadvantage of the seabed crawler vehicle is that it relies on competent and flat seabed terrain for stability during steering. There are notorious examples of severe instability occurring on unstable and sloping seabeds, which has caused the failure of entire mining projects. For example, the terrain around the richest type of mining deposits, seabed massive sulphides, is notoriously rugged.

The third disadvantage of the seabed crawler is that, in order to achieve high production rates, the crawler becomes very large. This is due to the relationship between production rate and excavation tool size, and the further relationship between excavation tool size and crawler size. Because the crawler must provide its own counter-balancing forces, only a fraction of the weight of the crawler can be applied to the excavation tool.

A further example of a method from the subsea mining industry is the use of a vertically-suspended trench cutter type excavator which is hung from a surface support vessel. FIGS. 5 and 6 illustrate a trench cutting system developed by Bauer Maschinen GmbH.

FIG. 6 shows the cutting frame and all the components of the trench cutter type excavator. It consists of a frame 1 with counter-rotating cutter wheels 5 at the base. The cutter wheels 5 inject the cuttings into the suction of a slurry pump 3 which provides power for hoisting the slurry a short distance, tens of meters. In examples of the present invention this would be sufficient to supply the excavation slurry to the bottom of a lift pipe which would have airlift or mechanical pumps or other lift methods to provide most of the power for lifting the excavation slurry potentially thousands of meters to the surface.

An advantage of the vertically-suspended trench cutter compared to the drill ship technique described above is that the section excavated in each cut is rectangular in plan (rather than circular as provided by the drill) and a continuous excavation plan is more efficiently formed. Like the seabed crawler, the trench cutter decouples the power transfer from the surface support vessel and provides it locally. A particular advantage is that the machine is very weight-efficient. The weight of the entire machine stands on the cutters, so the machine can be made much lighter than a seabed crawler with the same production rate. However the key disadvantage is that it is a one-dimensional excavator; there is no included means for creating a horizontal excavation trajectory.

Another technique that has been used is steering the drill bit 61 in a horizontal trajectory by means of tugger lines 62 from the deck of the surface support vessel 18. This technique is shown in Kuntz, U.S. Pat. No. 3,763,580 "Apparatus for Dredging in Deep Ocean," see FIG. 7. In this technique the tugger lines 62 act through sheave blocks 63 anchored into the seabed 23.

However, it is noted that the use of the tugger lines deployed from the deck of the surface support vessel will have practical limitations and will represent a disadvantage in ultra-deep water as described above in relation to techniques used by the marine dredging industry.

Yu U.S. Pat. No. 7,690,135 "Deep Sea Mining Riser and Lift System," describes a variation on the seabed crawler vehicle technique that replaces the flexible pipe 30 for lifting the slurry with rigid pipe 38 for the majority of length connecting the seabed crawler vehicle 53 to the surface support vessel 18. This patent describes that the use of flexible pipe 30 is now limited to a far shorter fixed length "jumper" section connecting between the crawler vehicle 53 and bottom of the rigid pipe 38. See FIG. 8.

DISCLOSURE OF THE INVENTION

It is an object of the present invention to provide methods and systems for efficiently excavating or mining the seabed. The excavation process requires positioning and stabilizing the excavator relative to the seabed and exerting force between the excavator and the soil, rock, ore, or other material to be excavated. Examples of the present invention address this process by exerting force between a subsea anchor point and an excavator using a subsea actuator. In some examples the subsea actuator is attached to an anchor point on the seabed and the excavator directly. In other examples, a guide frame is anchored to the seabed to provide anchor points fixed relative to the seabed and the subsea actuators are attached to the guide frame and the excavator. In further examples, the subsea actuators can be attached to the excavator through a carrier frame or other excavator guides rather than directly to the excavator.

According to a first example of the invention, a subsea excavation apparatus is provided. The apparatus comprises: an excavator; a first anchor point in a first fixed location relative to the seabed; a first subsea actuator attached to the excavator and the first anchor point for converting power to mechanical force between the first anchor point and the excavator; wherein the subsea actuator exerts force in response to actuator control signals. In some systems, the first subsea actuator is positioned and arranged to exert force primarily horizontally. In some other systems, the first subsea actuator is positioned and arranged to exert force primarily vertically. In many systems, the first subsea actuator is for converting electrical power to mechanical force. In some other systems, the first subsea actuator is for converting hydraulic power to mechanical force. In some systems, the first subsea actuator comprises a unidirectional actuator. In some other systems, the first subsea actuator comprises a bidirectional actuator. In many systems, the first subsea actuator is responsive to actuator control signals to manage the location of the excavator on an excavation face. In many systems, the excavator is responsive to excavator control signals. In some systems, excavator control signals and actuator control signals are provided interdependently to manage excavation location and rate.

According to a further example of the invention, a subsea excavation apparatus is provided that further comprises: a second anchor point in a second fixed location relative to the seabed; a third anchor point in a third fixed location relative to the seabed; a second subsea actuator attached to the excavator and the second anchor point for converting power to mechanical force between the second anchor point and the excavator; a third subsea actuator attached to the excavator and the third anchor point for converting power to mechanical force between the third anchor point and the excavator; wherein the second and third subsea actuator exert force in response to actuator control signals. In some such example systems, the first, second, and third subsea actuators are responsive to actuator control signals to manage the location of the excavator on an excavation face in three dimensions. In some examples, the actuator control signals are used to manage the orientation of the excavator on an excavation face. In some examples, the actuator control signals are used to manage the location and orientation of the excavator on an excavation face.

According to another example of the invention, a method for controlling a subsea excavator is provided. The method comprises: maintaining a plurality of anchor points at a fixed locations relative to the seabed; providing power to a plurality of subsea actuators; converting the power to a mechanical force with each subsea actuator; applying the mechanical forces between the subsea excavator and the plurality of anchor points; providing actuator control signals to the plurality of subsea actuators. In some such methods, the actuator control signals control the forces and moments on the excavator in three dimensions. In some example methods, the actuator control signals control the forces and moments exerted by the plurality of subsea actuators. In some such methods, the actuator control signals control the movement of the plurality of subsea actuators. In many example methods, the actuator control signals are used to manage the location of the excavator on an excavation face. In many example methods, the power is provided by a support vessel. In some example methods, the plurality of subsea actuators comprises unidirectional actuators. In other example methods, the plurality of subsea actuators comprises bidirectional actuators.

In a further example of the invention, a method for controlling a subsea excavator is provided that further comprises providing excavator control signals to the excavator.

MODES FOR CARRYING OUT THE INVENTION

Examples embodiments of the present invention overcome the disadvantages in the prior art as described above and consequently provide more efficient systems and methods for Seabed Excavation particularly in ultra-deep water conditions. The example embodiments provide economic advantages compared to previous techniques.

Figure 6:
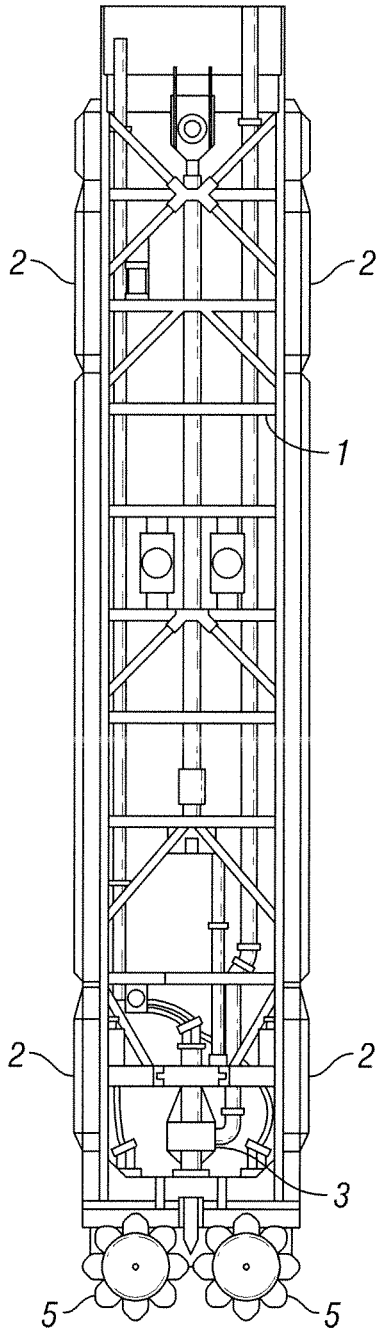
FIG. 6 Prior Art
FIG. 6 is a side view of a vertical trench cutter used for seabed mining.
Figure 8:
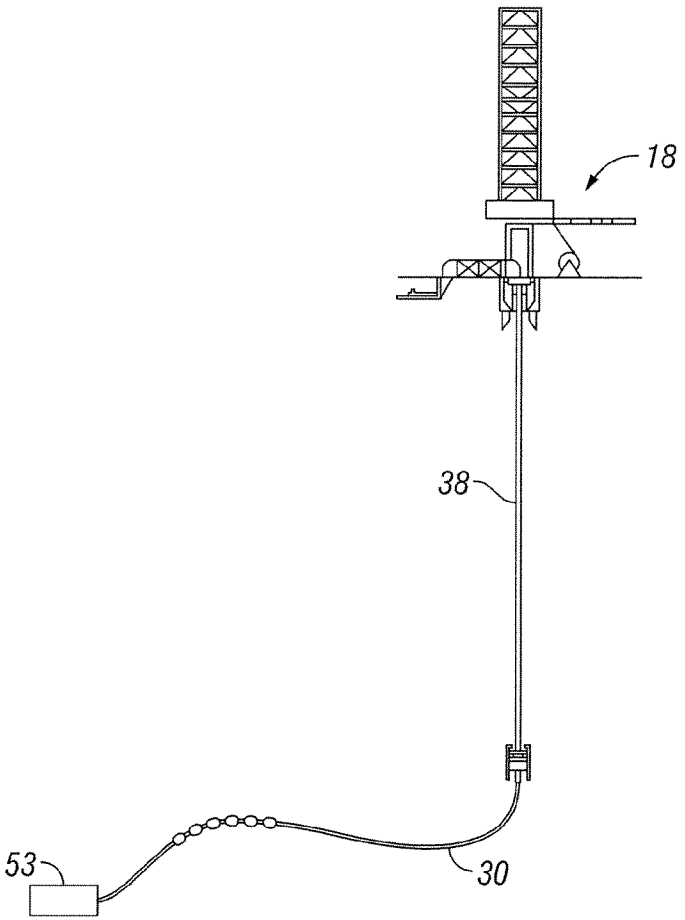
FIG. 8 Prior Art
FIG. 8 is a side view of a seabed crawler type apparatus using a combination of flexible and rigid pipe for lifting excavated slurry.

These example embodiments can utilize existing, weight-efficient excavating and cutting technology, for example the Bauer trench cutter (FIG. 6), but is not limited to this particular type of excavator. For example, other excavators such as roadheaders, vertical miners, hydromills, jet cutters, and rotating drums could be used in these examples.

These example embodiments can use a wide variety of existing actuators, including unidirectional actuators such as winches and cables and/or bidirectional actuators such as hydraulic cylinders, electromechanical actuators, screw drives, rack and pinion drives, and gear drives.

These example embodiments can also use a wide variety of seabed anchor technologies to provide anchor points including: gravity anchors, drilled and grouted piles, suction piles, drag embedment anchors, torpedo anchors, and screw anchors.

In at least one example embodiment of the invention, a subsea excavation apparatus is provided that includes an excavator that is positioned by subsea actuators in response to actuator control signals. The actuator control signals can command either or both a specific force or position from the actuator. Each subsea actuator converts power into mechanical force and is mounted between an anchor point in a fixed location relative to the seabed and the excavator. In various example embodiments, the subsea actuator receives either electric or hydraulic power from a surface support vessel. By providing a subsea actuator that is attached to an anchor point, these examples increase efficiency of deep sea operation and require less costly surface support vessels and/or platforms than previous methods. Because the excavator is positioned relative to an anchor point that is fixed relative to the seabed, costly support vessel station keeping and motion compensation systems are not required. Additionally, the necessity for long mechanical linkages between the surface and seabed are replaced with more efficient means of providing power to the seabed, such as electrical or hydraulic transmission.

In further examples, the actuator control signals to multiple subsea actuators can manage excavation rate and location by controlling the position of the excavator relative to the seabed in three dimensions and controlling the force exerted on the excavation face by the excavator.

In further example embodiments, the excavator may be responsive to excavator control signals to control the rate of excavation and/or extraction of excavated materials.

In further example embodiments, the actuator and excavator control signals are adjusted in concert to control the rate of extraction. The excavator and actuator control signals may operate in a feedback loop where each is adjusted in response to the other, or in response to feedback from either the excavator or actuators. For example, if the torque requirements on THE excavator's rotating cutter start to exceed its capabilities, the excavation rate could be reduced by either reducing the force exerted on the excavator by the actuators toward the excavation face and thereby reducing the effective depth of the cut, or by reducing the force exerted on the excavator by the actuators along the excavation face thereby reducing the advance rate of the excavator.

In further example embodiments, the system can contain three or more subsea actuators to exert force on the excavator in three dimensions.

In other example embodiments, a method for controlling a subsea excavator is provided where anchor points are maintained in fixed locations relative to the seabed, power is provided to a subsea actuator, the subsea actuator exerts force between an anchor point and the excavator in response to actuator control signals. This method can be applied with the example system embodiments described. By providing a subsea anchor point and subsea actuator, these examples increase efficiency of deep sea operation and require less costly surface support vessels and/or platforms than previous methods. Costly support vessel station keeping and motion compensation systems are not required because the excavator is positioned relative to the seabed rather and a surface support vessel or platform. Additionally, the necessity for long mechanical linkages between the surface and seabed can be replaced with more efficient means of providing power to the seabed, such as electrical or hydraulic transmission.

One example embodiment is a method to utilize existing excavators to efficiently mine in the deep sea. This involves the use of remotely controlled equipment, coupled with the weight of the machine, to accurately control the excavation trajectory of the machine, in three dimensions, over large areas.

One example embodiment uses subsea winches as actuators, flexible and rigid pipe (for lifting of an excavated slurry), a controllable lowering winch for the excavator and vertical actuator, Remotely Operated Vehicles, and possibly a submerged, suspended guide frame to facilitate control of the excavator.

Figure 1:
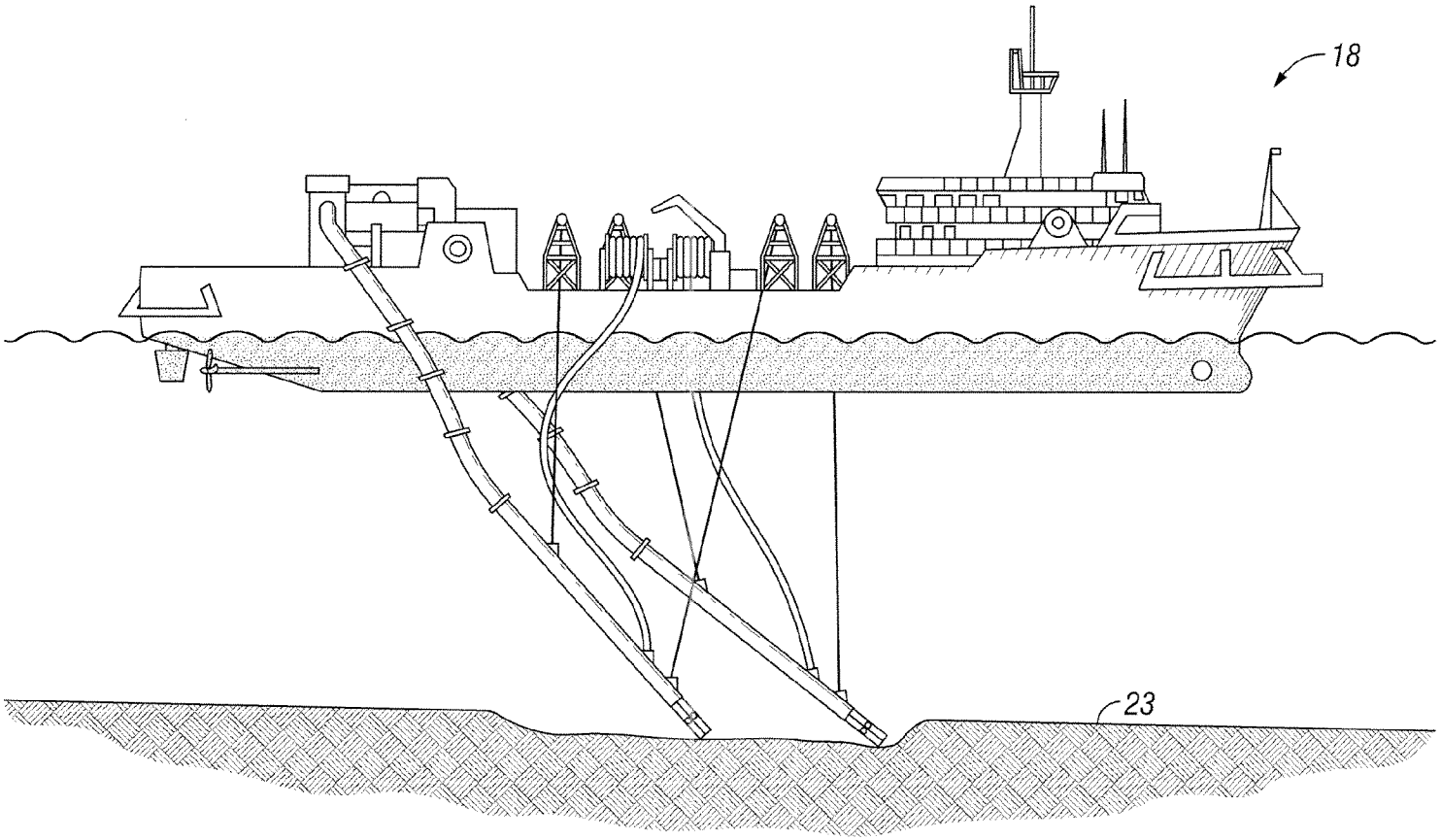
FIG. 1 Prior Art
FIG. 1 is a side view of a trailer suction dredger.
Figure 2:
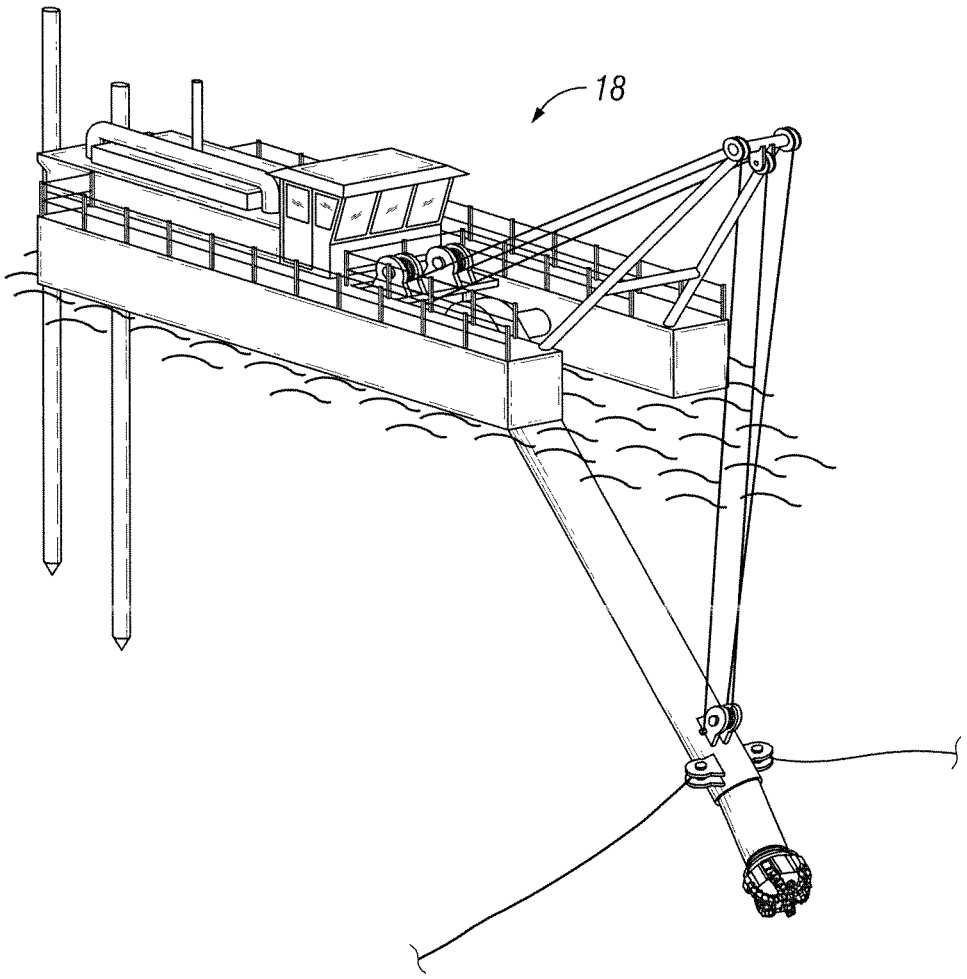
FIG. 2 Prior Art
FIG. 2 is a perspective view of a cutter suction dredger.
Figure 3:
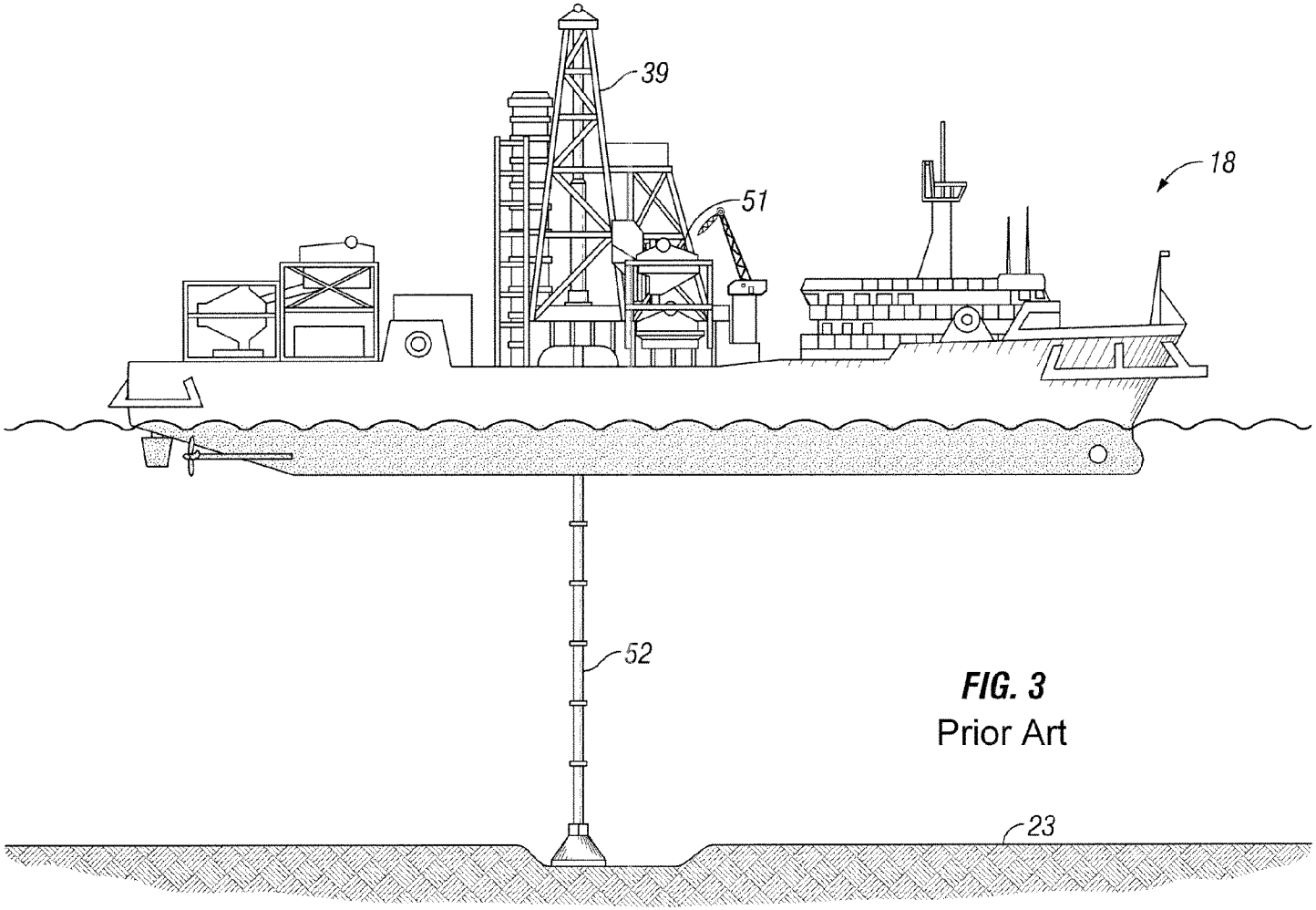
FIG. 3 Prior Art
FIG. 3 is a side view of a drill ship used for seabed mining.
Figure 4:
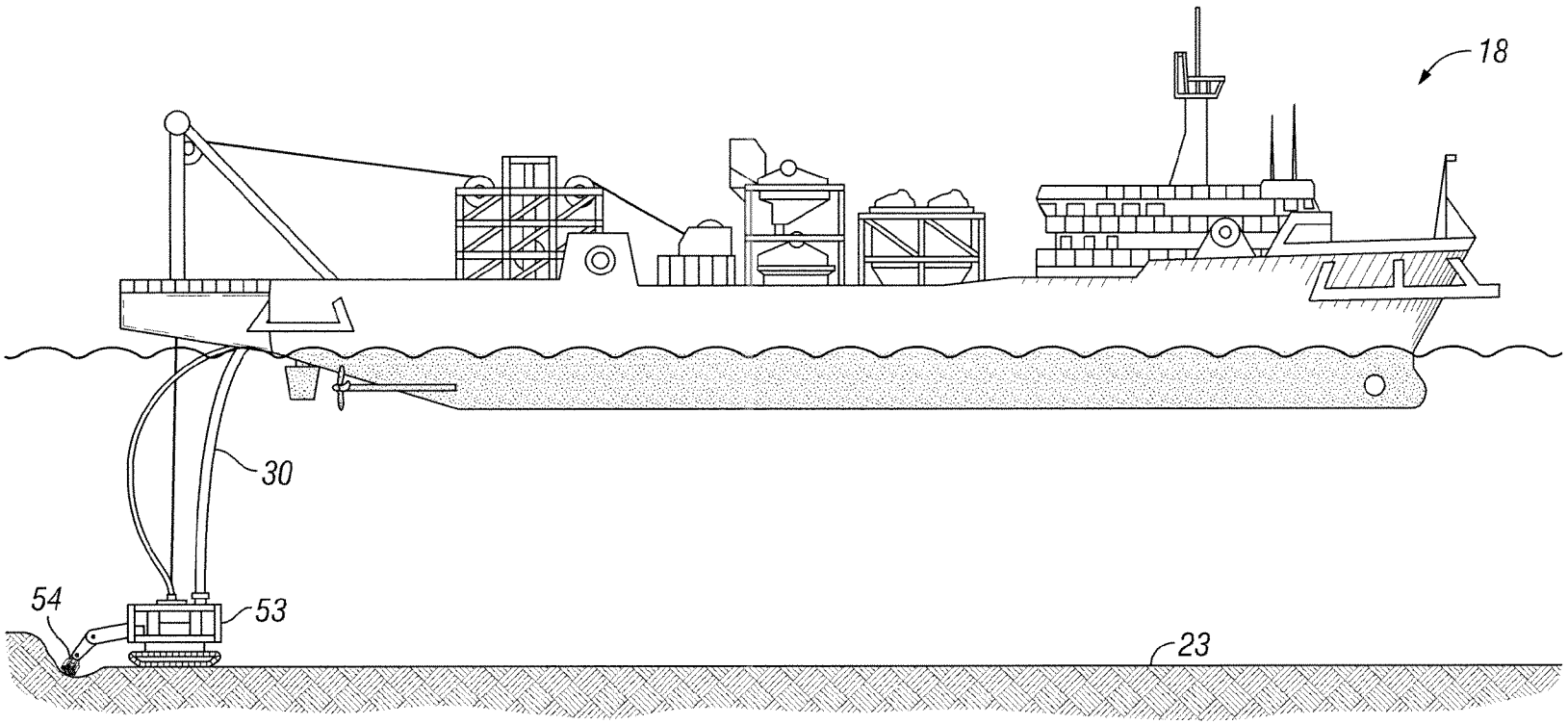
FIG. 4 Prior Art
FIG. 4 is a side view of a drill ship and seabed crawler vehicle used for seabed mining.
Figure 5:
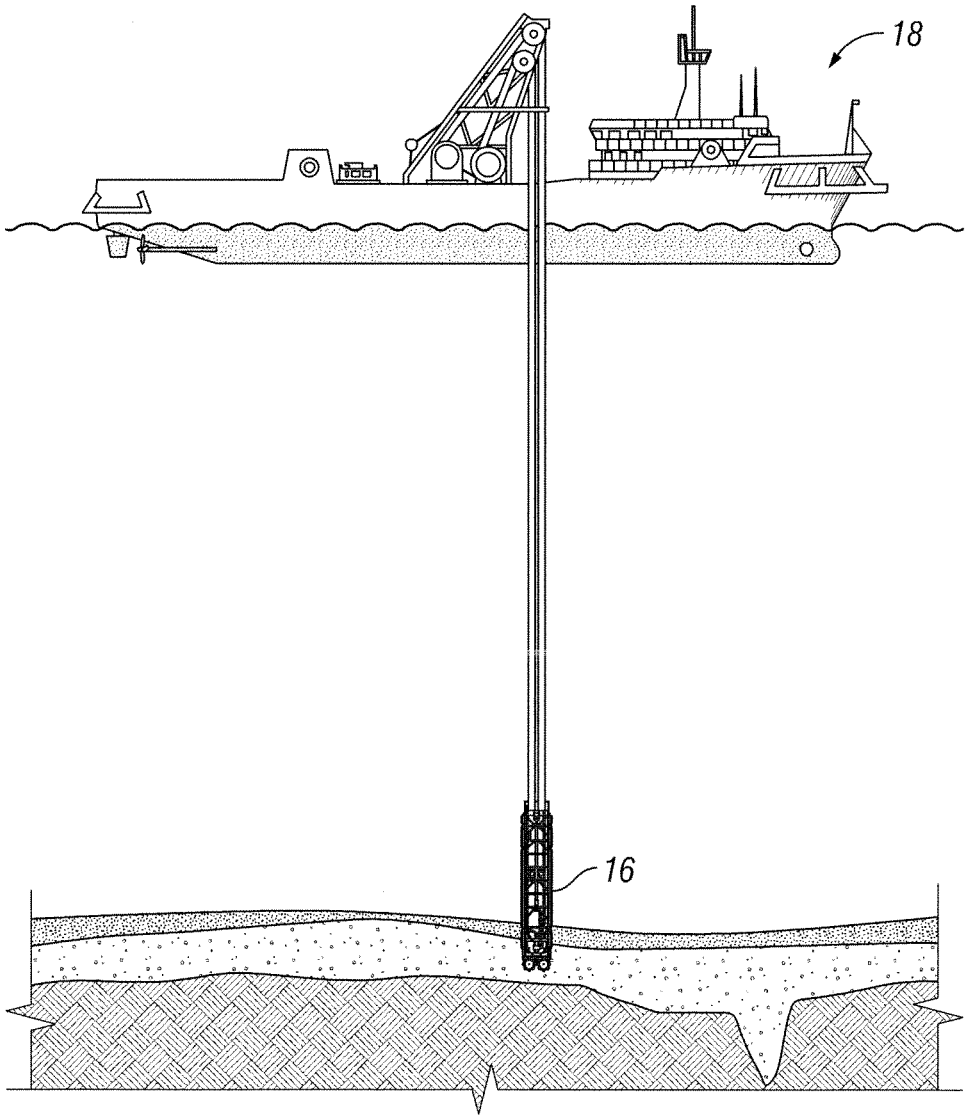
FIG. 5 Prior Art
FIG. 5 is a side view of a surface support vessel and vertical trench cutter used for seabed mining.
Figure 7:
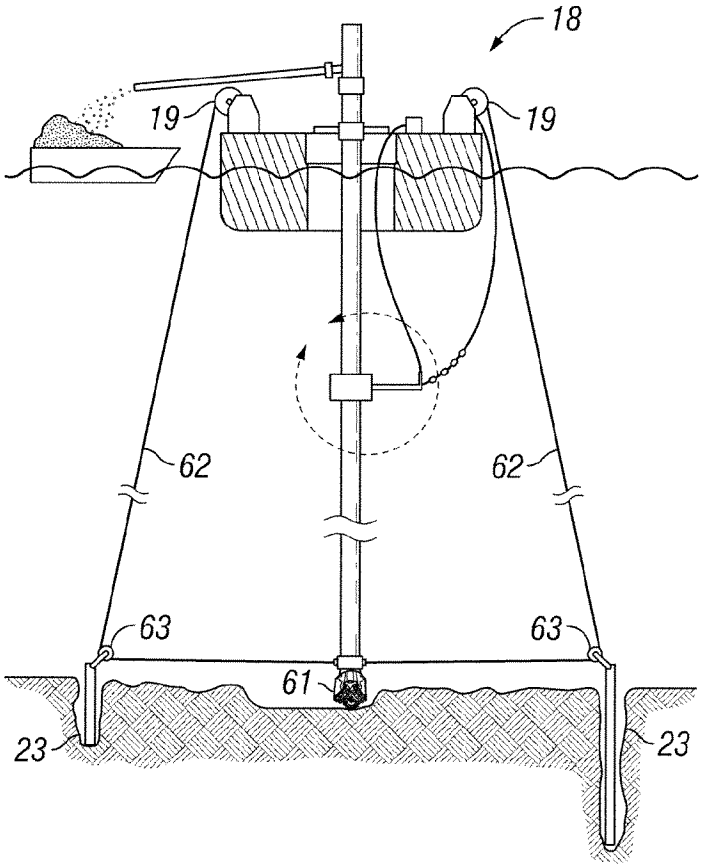
FIG. 7 Prior Art
FIG. 7 is a side view of apparatus for dredging in deep ocean using tugger lines and sheaves on the seabed.
Figure 9:
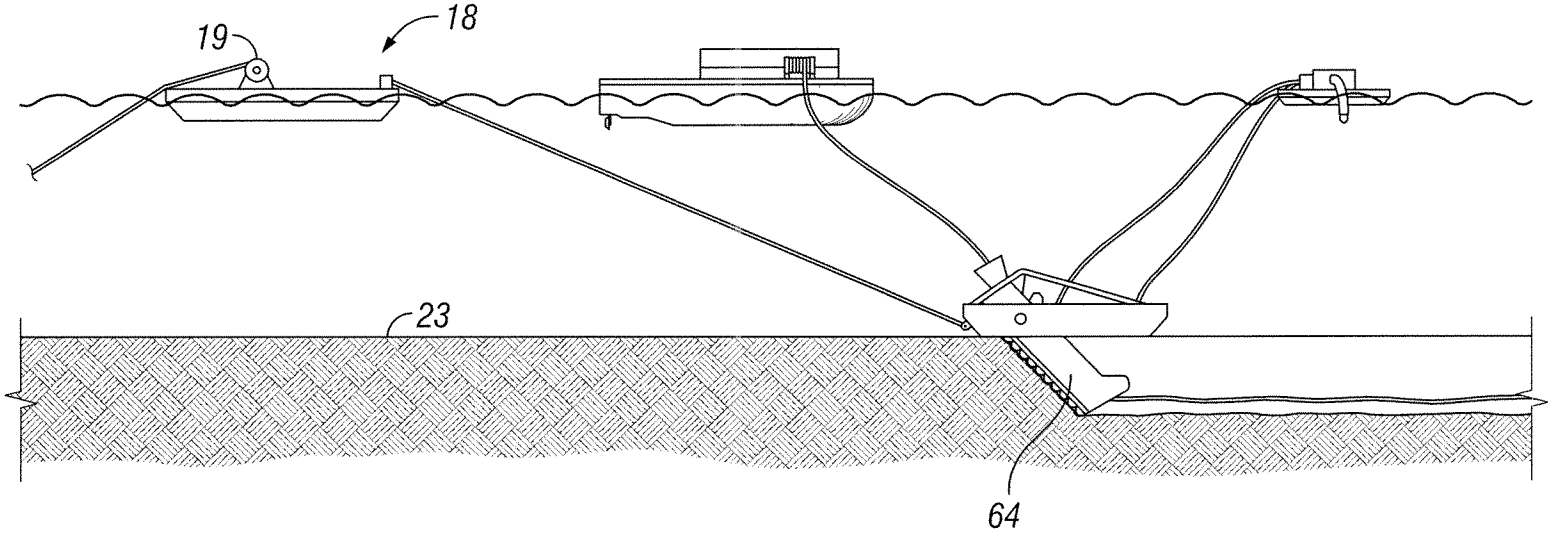
FIG. 9 Prior Art
FIG. 9 is a side view of an underwater cable burial system.

As mentioned above, the means for guiding subsea excavating equipment has traditionally been one of the following means: 1) maneuvering the support vessel 18 by means of anchor lines or thrusters to control a suspended pipe or cable (see e.g. FIG. 1, FIG. 3); 2) using winches 19 mounted on the surface vessel 18 together with sheaves 63 on the seabed 23 to apply a horizontal force to a suspended excavator (FIG. 7); 3) using winches on a surface vessel 18 pulling on a fixed point to apply horizontal forces to a seabed trencher 64 (FIG. 9); 4) using a seabed crawler vehicle 53 to control the movements of an excavation tool 54 on an extended arm (FIG. 4).

Examples of the present invention introduce the use of subsea actuators (such as winches and hydraulic cylinders), ROVs, cable supported excavators and seabed anchors to allow for efficient extraction of minerals from the seabed. This approach has not been used previously for a variety of reasons. First, it has been stated that solutions involving a winch anchored to a fixed point as in FIG. 7 could not be applicable over a wide area of the seabed (see U.S. Pat. No. 6,273,642).

This objection is overcome in examples of the present invention by allowing the use of a fixed point relative to the seabed as the anchoring point in combination with a subsea actuator. In some examples this anchor point is a gravity anchor, a drilled and grouted pile, a driven pile, a suction pile, a drag embedment, a torpedo anchor, a screw anchor, or a subsea drilled anchor.

Placing a fixed anchor point on the seabed in the deep sea is constrained by the magnitude of the lateral forces required to cut the rock. In some examples of the invention, this objection is overcome by minimizing these forces through the use of an excavator which provides the primary cutting forces by its own weight. Two excavating scenarios are envisioned. In one case the excavator, similar to FIG. 6, makes essentially vertical cuts and may mine a deposit be cutting a series of vertical holes. The vertical cuts do not require any lateral forces to be applied for cutting. Experience in surface and shallow water excavation has shown vertical trench cutting to be an extremely weight-efficient means of excavating soil, rock, and ore.

Examples of the invention may be used for either vertical excavation (similar to trench cutting), or lateral excavation (similar to strip mining).

Figure 10:
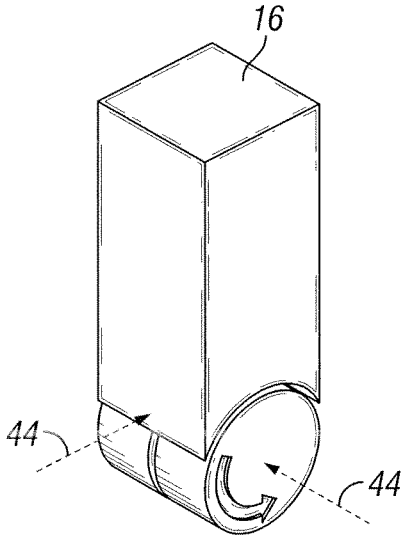
FIG. 10 is a perspective view of lateral reaction forces applied to an excavator.

According to some examples embodiments, it is possible to completely excavate a deposit by vertical cutting alone. A vertical cutting machine type excavator can excavate a trench in one direction using the weight of the excavator alone to stabilize the cut. The weight of the device can be sufficient to provide cutting forces without any external forces being applied. Inclination of the cutter is arrested by bearing pads 2 on the outside of the cutter frame 1 which bear against the walls of the trench. Mining an open pit with such a device is more complicated. Various hole-patterns for an open pit process using a trench cutter are possible. The cutter may be rotary (creating a circular hole) or rectangular (creating a rectangular hole). As the pit is expanded, the cuts are made without the aid of trench walls for support. Lateral reaction forces 44 are provided to maintain the stability of the excavator 16, shown in FIG. 10.

Figure 11B:
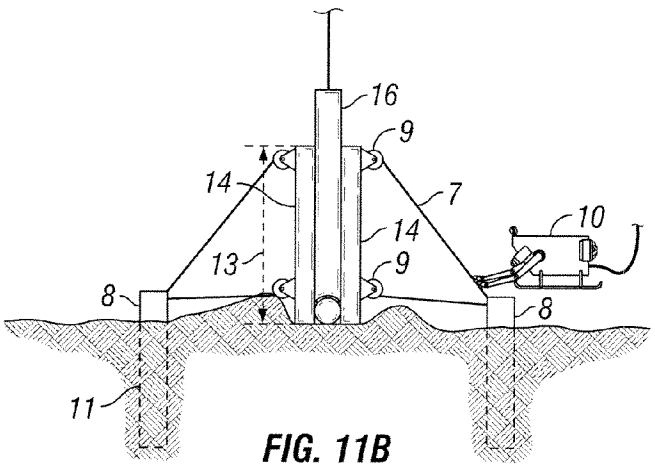
FIG. 11B is a side view of an excavator attached to anchor points using cables.
Figure 11D:
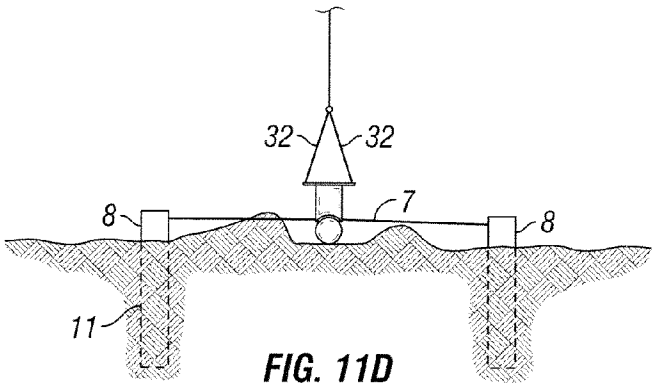
FIG. 11D is a side view of an excavator attached to anchor points using cables.
Figure 11A:
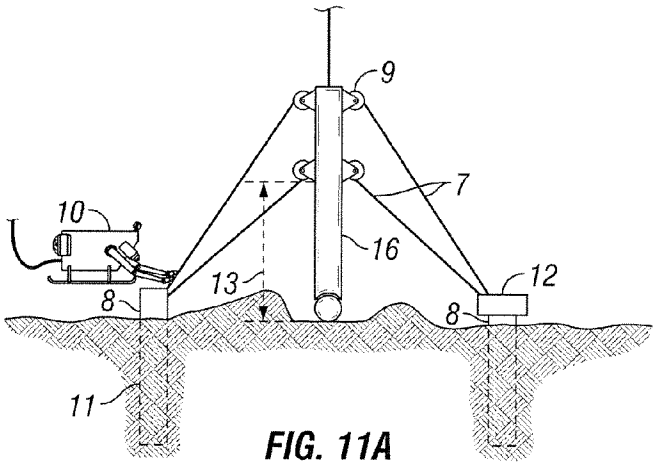
FIG. 11A is a side view of an excavator attached to anchor points using cables.

FIGS. 11A-D show example embodiments involving the use of cables 7 to stabilize the vertical excavator 16. FIG. 11A is one embodiment of the invention whereby the cables 7 are attached to an anchor point 8 on the seabed 23. The operation of this example embodiment would employ a submerged winch 9 as a subsea actuator on the excavator 16 powered by an electric or electro-hydraulic motor. The winch cable 7 would be drawn from the winch 9 and attached to the anchor point 8 by means of a remotely operated vehicle (ROV) 10. The anchor points 8 may be either permanently or temporarily fixed in the seabed with piles 11, clump weights 12, gravity anchors, drilled and grouted piles, suction piles, drag embedment anchors, torpedo anchors, and/or screw anchors.

In the example embodiment shown in FIG. 11A, the use of cables to stabilize a cut limits the depth of the cut 13 because of interference with the walls of the trench. Alternate embodiments which mitigate this limitation are shown in FIGS. 11B-D and 15.

In the example embodiment shown in FIG. 11B, carrier frame 14 encases the vertical excavator 16 and is held in position with cables 7. In this embodiment winches 9 would be attached to the carrier frame 14 and connected to the anchor points 8. The ROV 10 would be used to attach the cables 7 to the anchor points 8.

Figure 11C:
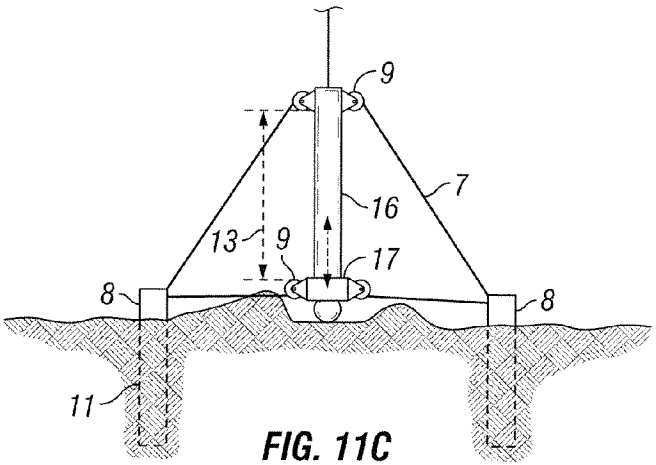
FIG. 11C is a side view of an excavator attached to anchor points using cables.

The example embodiment shown in FIG. 11C utilizes a sliding collar 17 to position the bottom of the excavator 16. In this embodiment the wire would be deployed from winches 9 on the sliding collar 17 and the excavator 16. Cable 7 would be deployed from these winches 9 to the anchor points 8 in the same manner as described above.

The example embodiment shown in FIG. 11D utilizes bridle lines 32 to stabilize the tilting of the excavator 16 and lateral cable actuators 7 provide horizontal control.

Figure 12:
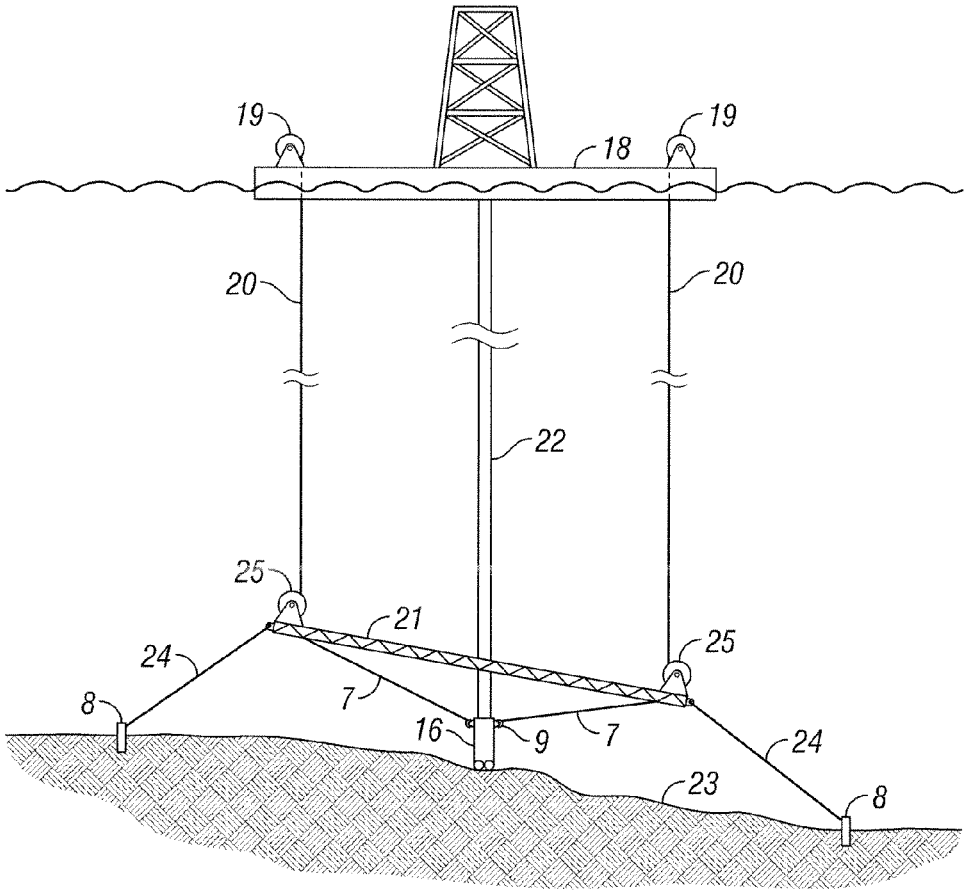
FIG. 12 is a side view of an excavator attached to a guide frame attached to anchor points.

FIG. 12 shows another example embodiment where a guide frame 21 is supported on cables 20 from a support vessel or platform 18. The length of cables 20 may be adjusted with winches 19 on the support vessel 18 to change the angle of the guide frame 21 in order to conform to the slope of the seabed 23. The guide frame 21 is connected to the seabed 23 with cables 7 attached to anchor points 8. The guide frame 21 is thus stably suspended from the support vessel 18 with cables 20, and connected to the seabed with cables 24 attached to anchor points 8. The excavator 16 is supported from the surface platform 18 by riser pipe or cable 22. It is further guided as in other example embodiments by cables 7 which connect the excavator to the guide frame 21 for support. In this example, the cables 7 are stored on winches 9 which are connected to the excavator 16. In operation the cables 7 are attached to the frame 21 using an ROV in a manner similar to the use of the ROV to connect the cables 7 to anchor points 8 in the example embodiment shown in FIGS. 11A-D. The winches 9 could alternately be attached to the frame 21 in which case the cable 7 would be connected to a fixed point on the excavator 16.

Figure 13:
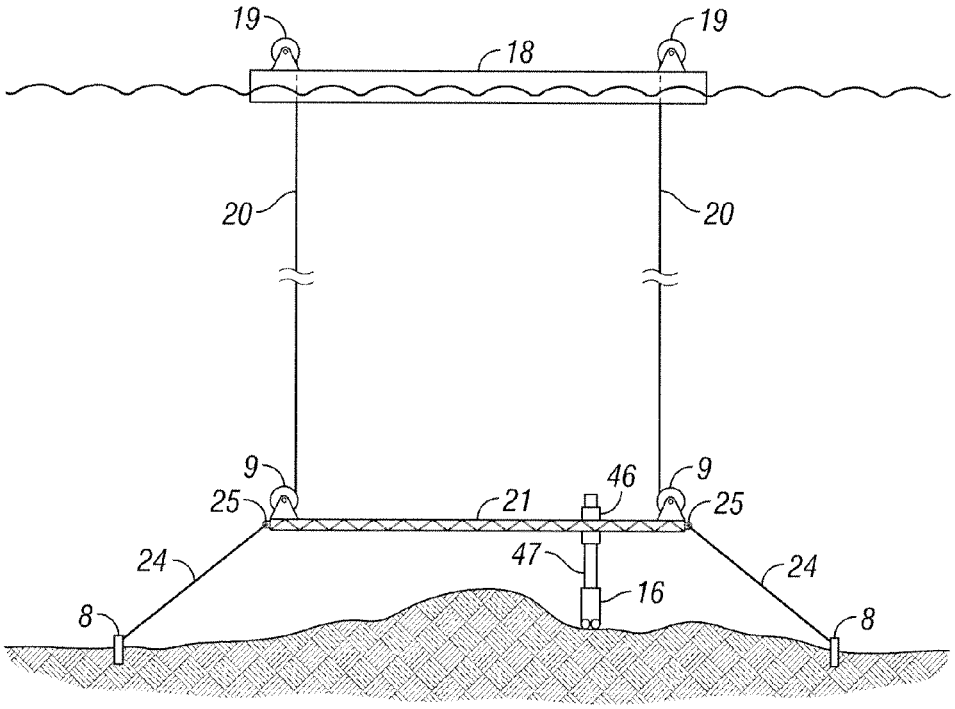
FIG. 13 is a side view of an excavator attached to a guide frame with a vertical actuator.

In the example embodiment shown in FIG. 13, an excavator is attached to a guide frame 21. The guide frame 21 is supported from the surface vessel 18 by cables 20 and anchored to the seabed 23 by cables 24. This arrangement allows the frame to provide vertical and horizontal reaction forces to the excavator 16. For example, the vertical cutting force may be reacted by the vertical component of the forces in the cable 7. The excavator 16 is positioned horizontally within the guide frame 21 by subsea actuators (not shown) acting in a generally horizontal plane. The vertical position of the excavator 16 is controlled by a vertical subsea actuator 46 and rigid strut 47. The vertical actuator 46 can therefore control the force between the excavation face and the excavator 16. In this example, the guide frame 21 acts as intermediary anchor points between the excavator 16 and the seabed anchors 8, which ultimately provide reaction points for the forces acting on the excavator 16. In a further example embodiment, the anchor cables 20 are replaced by rigid legs between the guide frame 21 and the seabed 23.

Figure 14:
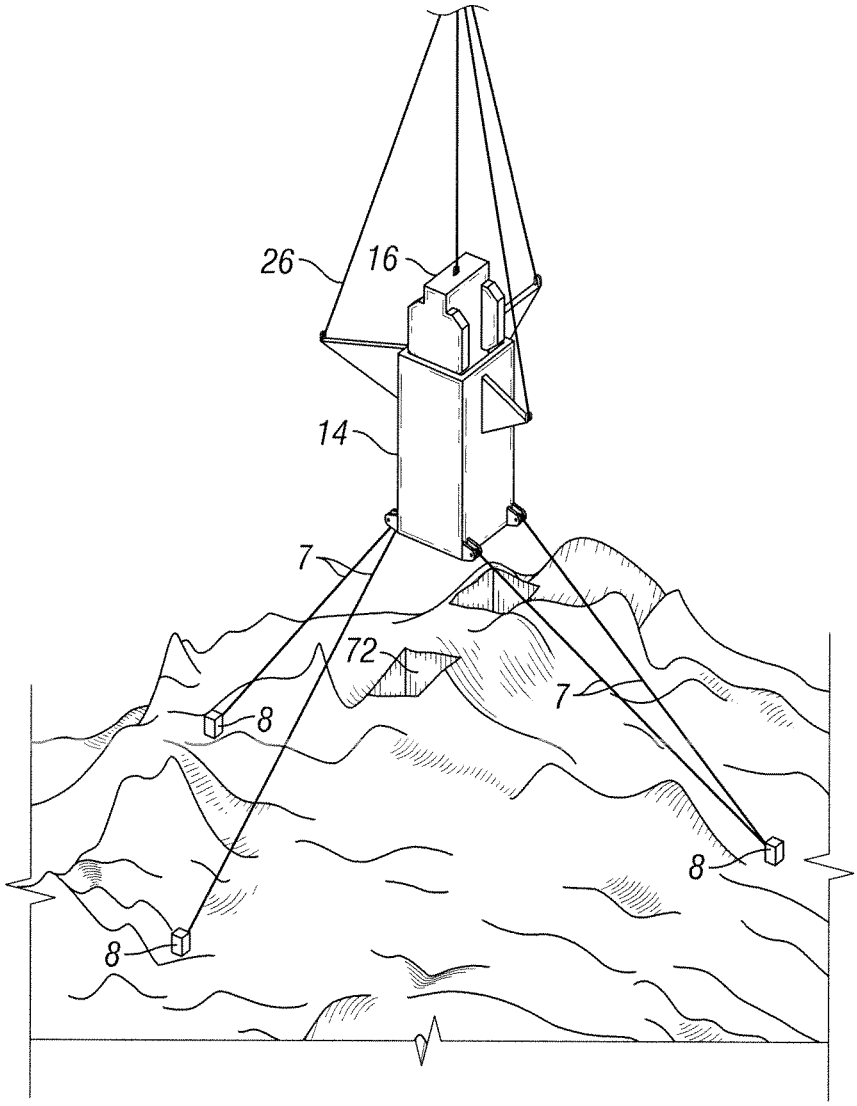
FIG. 14 is a perspective view of an excavator within a carrier frame attached to anchor points using cables.

FIG. 14 shows perspective view of an example embodiment similar to that shown in FIG. 11B. Several cables 7 are attached to a carrier frame 14. The cable lengths 7 may be adjusted to achieve a desired position and orientation of the carrier frame 14 and excavator 16 for making a new excavation to expand a pit 72.

The above examples pertain primarily to vertical excavation which may be the most efficient available for irregular sea beds, pillars and very narrow deep deposits. As noted those examples require guidance of the cutter during pit expansion, which may be difficult with a cable guided system. The following examples illustrate how the same basic cutting machine may be extended for lateral cutting similar to surface mining using cable and winch guidance.

Figure 15:
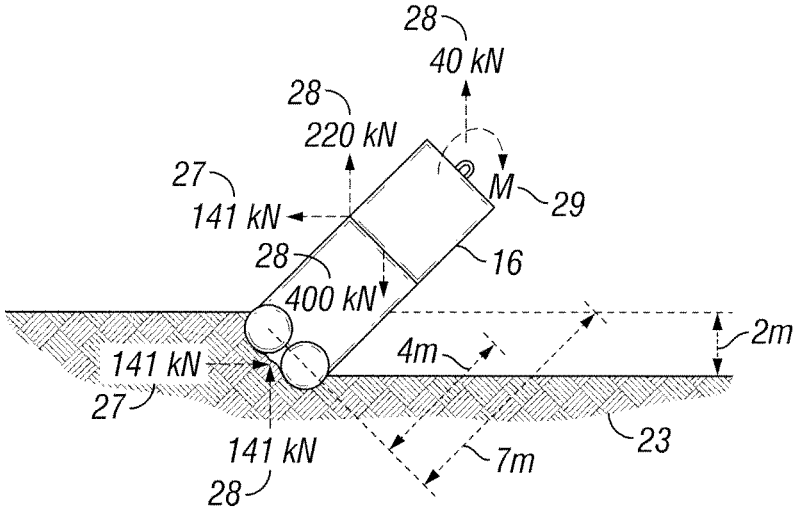
FIG. 15 is a side view illustrating forces on an excavator in lateral mining.

FIG. 15 shows an excavator 16 which is inclined at a non-orthogonal angle with respect to the seabed 23. To achieve stable lateral mining the horizontal forces 27, vertical forces 28 and moment 29 on the cutter frame must be in equilibrium as follows: 1) sum of horizontal forces 27 must be equal to zero; 2) sum of vertical forces 28 must be equal to zero; 3) moment 29 resulting from all of the vertical and horizontal forces must be zero. This means that subsea actuators and the weight of the excavator must provide forces on the excavator sufficient to excavate the rock. A typical example scenario is provided by FIG. 15 and parameters corresponding to computations performed utilizing a Bauer BC50 cutter used on a typical massive sulfide rock deposit. These parameters are: UCS average 20 Mpa (up to 80), Density of 2.4; footprint 840×3200 mm; load on bit 5-20 tons; machine weight 40 tons; 500 kW hydraulic power; 0.4 cubic meter per minute production; tooth replacement every 16 hours of excavation. In this example calculation the horizontal force applied to the excavator is 141 kN; the vertical force applied to the excavator is 220 kN; and the weight of the excavator is 40 kN.

This principle of static equilibrium is well known in engineering mechanics. The values in this example are only for illustration and specific values will vary from application to application due to different cutter head weights and dimensions, and different rock cutting forces. In order to maintain equilibrium for different cutting forces the external applied loads will need adjustment.

Figure 16:
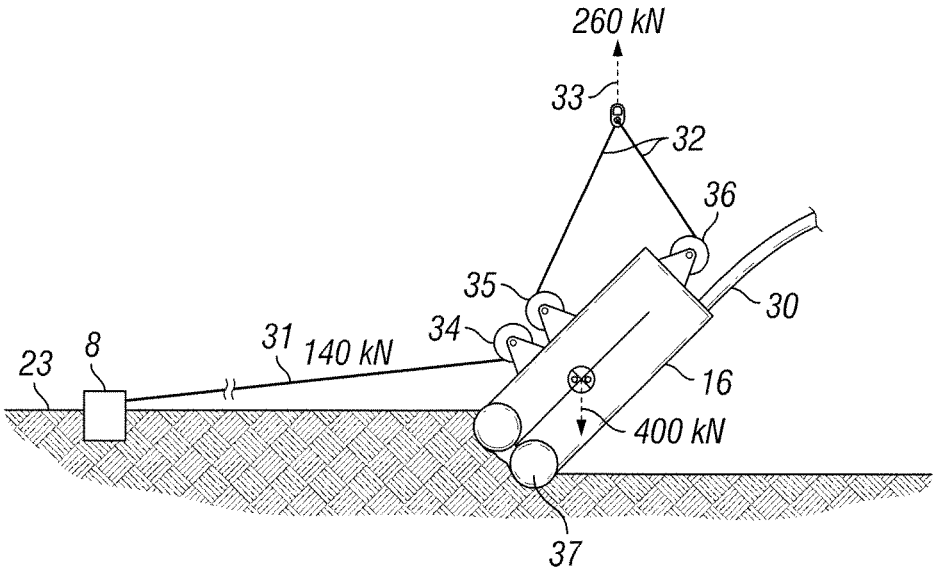
FIG. 16 is a side view of an excavator in lateral mining.

FIG. 16 shows an example embodiment which may achieve control over the orientation and of the cutter at a suitable cutting angle using three winches 34, 35, and 36 on the excavator 16. One winch 34 is connected to a cable 31 (the "drag line") which attached to an anchor 8 fixed to the seabed 23. This winch 34 and drag line 31 are used to apply a force between the cutter heads 37 and the seabed rock 23, and to control the forward advance of the excavator 16. Winches 35 and 36 are used to control the respective bridle lines 32 attached to the lifting lines 33. The lifting line 33 is supported by a support vessel or platform 18 or a guide frame 21. By controlling these bridle lines 32 attached to winches 35 and 36 respectively the moment on the frame may be adjusted to achieve the desired excavator angle. Sensors on the excavator frame, including inclinometers and tension gauges (for the lines), can be used to establish control of the excavator 16.

Figure 17:
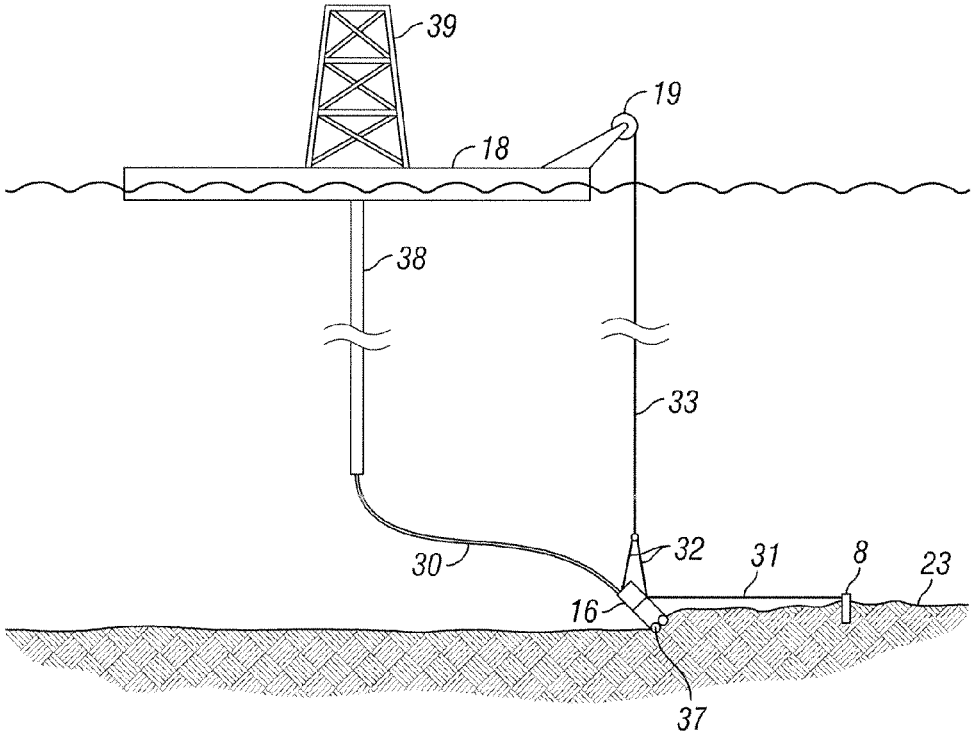
FIG. 17 is a side view of an excavator in lateral mining and associated lift system and support vessel.

FIG. 17 shows how this example system may be integrated with the support vessel 18 and the lift pipe 38. The excavator 16 is supported by a bridle 32 and a cable 33 by a motion compensated winch 19 on board the support vessel 18. When the excavator 16 is first lowered to the sea floor 23 the individual lines of the bridle 32 are adjusted to achieve the correct excavator angle (as shown in FIG. 16). The drag line 31 is attached to anchor point 8 using a remotely operated vehicle (ROV). A flexible pipe 30 for the lift system is also attached by the ROV between the excavator 16 and the rigid lift pipe 38. The rigid lift pipe 38 is supported by a derrick 39 or other supporting structure. Pumping of fluid through the flexible pipe 30 and rigid lift pipe 38 commences using either a mechanical pump or airlift. Next a slurry booster pump on the excavator 16 is started and finally the cutting wheels 37 are activated. Power for the cutting wheels 37 and slurry pump are provided by a separate umbilical (not shown) which is run with the lifting line 33. The anchor point 8 for the drag line 31 may be a clump weight which may be preset by the same lifting line 33 used for the excavator 16, a piled anchor drilled by a subsea drill, gravity anchor, drilled and grouted pile, suction pile, drag embedment anchor, torpedo anchor, and/or screw anchor.

Figure 18:
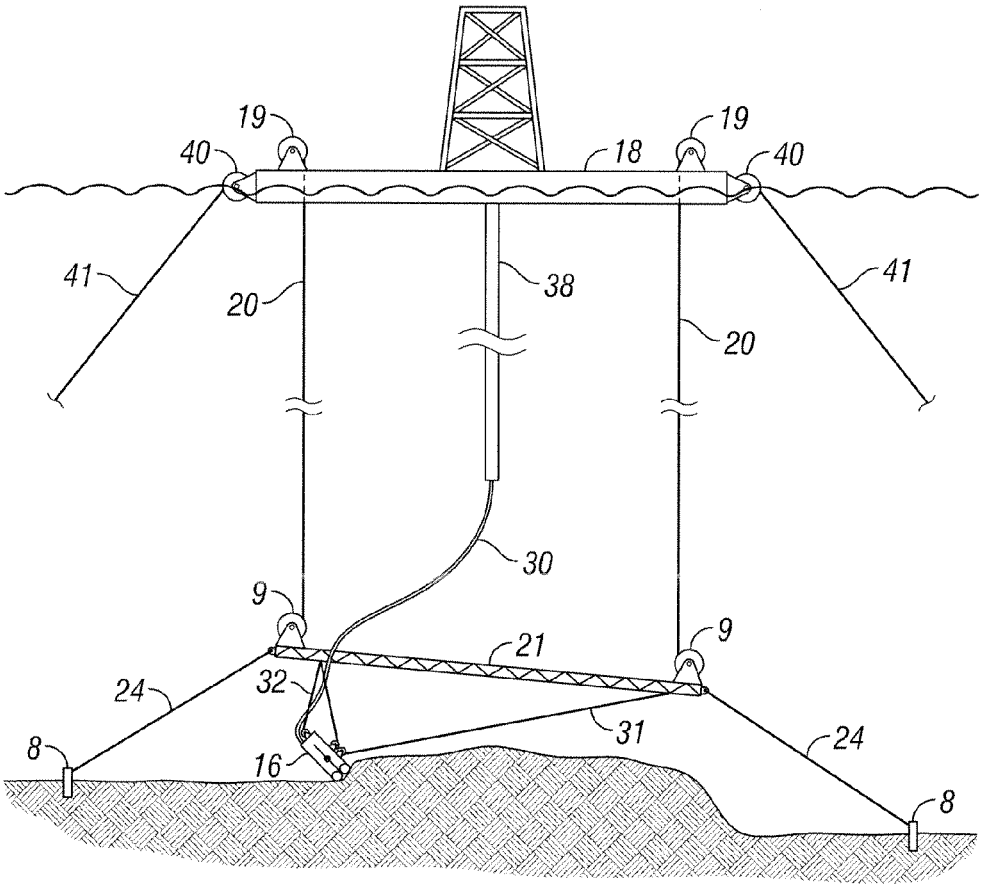
FIG. 18 is a side view of an excavator in a guide frame for lateral mining and associated lift system and support vessel.

FIG. 18 shows an example embodiment for lateral mining using the guide frame 21 previously discussed in relation to FIGS. 12 and 13. This may be advantages for topographies where the drag line 31 cannot ride along the bottom, or if the lifting line 33 is not stiff enough to control the dynamics of the excavator 16. The subsea guide frame 21 can be anchored and suspended from the support vessel/platform 18 as shown, or it can be attached to the seabed 23. In this example embodiment, the drag line 31 is affixed to an anchor point on the guide frame 21 instead of an anchor point directly on the seabed 8. The guide frame 21 is controlled by cables 24 which are attached to the seabed at anchor points 8, and winches 9 attached to the frame. The entire guide frame is suspended on cables 20 from the support vessel/platform 18. Excavation is controlled by the drag line 31 and winch 34 (see FIG. 16). In this case the position of the guide frame 21 may be moved by adjusting the length of lines 24 using winches 9, and at the same time adjusting the position of the surface platform by adjusting the lengths of mooring lines 41 using winches 40.

Figure 19:
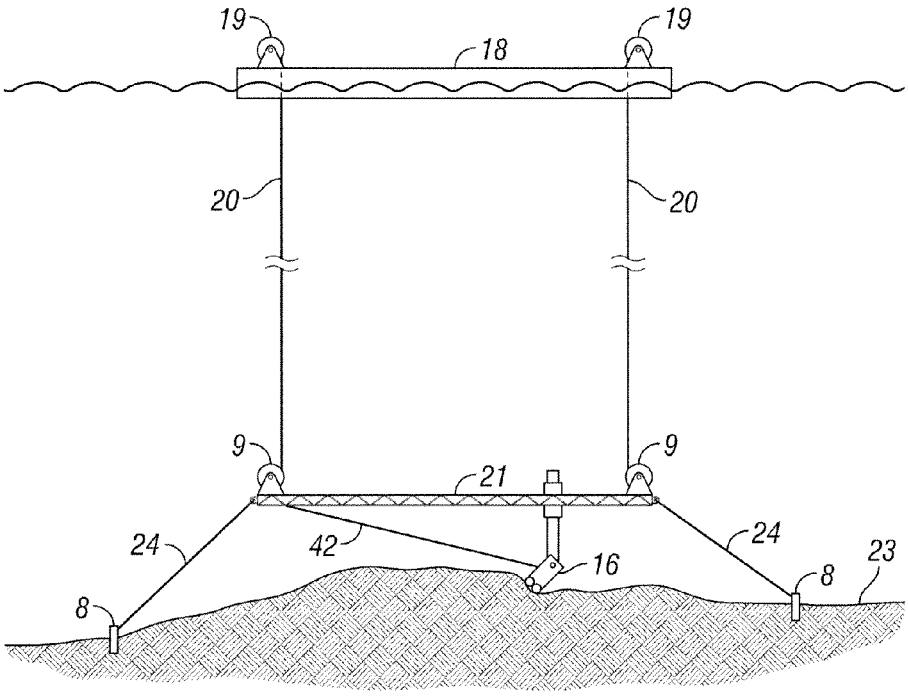
FIG. 19 is a side view of an excavator in a guide frame for lateral mining and associated lift system and support vessel.
Figure 20:
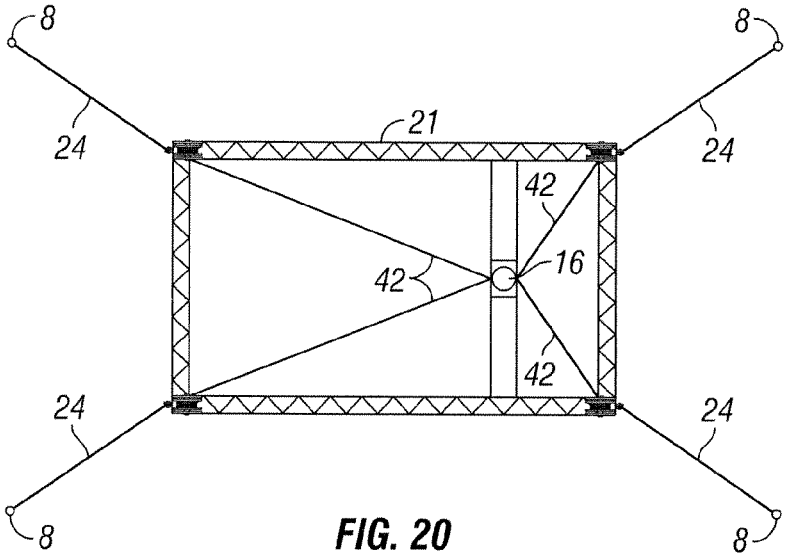
FIG. 20 is a plan view of an excavator in a guide frame for lateral mining.

Another embodiment using the submerged frame is shown in FIGS. 19 and 20. The anchor lines 24 between the guide frame 21 and an anchor point 8 on the seabed 23 are capable of reacting to the vertical cutting forces. Here they are also used to provide horizontal reaction forces as the excavator 16 is moved horizontally across the seabed 23. The control of the horizontal motion is affected by control lines 42 between the excavator 16 and the guide frame 21, which is in a fixed position relative to the seabed 23 by virtue of the anchor lines 24. The plan view of FIG. 20 shows the guide frame 21 with the control lines 42 and anchor lines 24.

Figure 21:
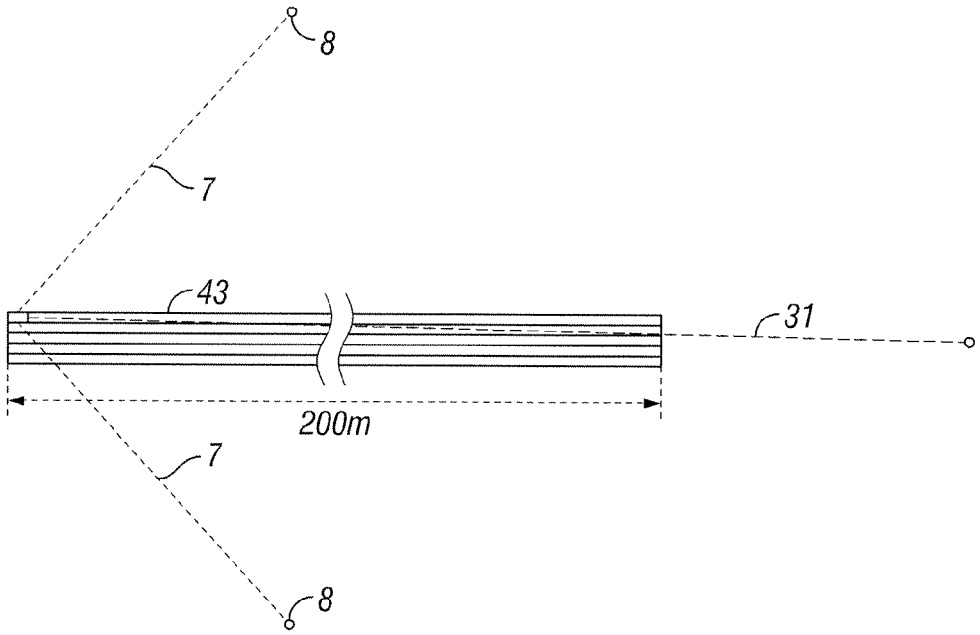
FIG. 21 is a plan view of a lateral mining operation.

FIG. 21 shows a plan view of an example of the lateral/surface excavation embodiment. The seabed rock 23 is cut in approximate 0.8-1.6 m wide strips 43 (depending on the cutter arrangement) approximately 2.0 m deep. The excavator 16 needs to be stabilized as it cuts adjacent rows. This figure shows lateral control lines 7 which are attached to the excavator 16 and to an anchor point 8 on the seabed. Control lines 7 are controlled by winches 9 which may be attached to the cutting excavator 16 or the anchor point 8 in the same manner as the control lines 7 are used for the vertical mining tool embodiments discussed above.

Note that the cutter is not restricted to making passes of equal depth, whether it is dragged by anchor points attached to a guide frame or to the seabed—the depth of cut can be varied to "sculpt" the seabed, e.g. to excavate a rounded pit to follow an orebody. Furthermore, the heading orientation of the machine can be changed, e.g. using cables as shown in FIG. 13 or through other means, e.g. by modifying a carrier frame such as shown FIG. 11 to be cylindrical, then rotating the excavator or cutter head inside the cylinder. By changing the heading orientation of the cutter and by using three or more drag lines, the cutter can be used to sculpt an excavation in three dimensions. Examples of the invention therefore include the ability to use a combination of vertical and horizontal forces to excavate a pit of arbitrary shape on large areas of rugged terrain.

Also note that, if a frame as shown in FIG. 18 is used, the means of generating lateral forces are not restricted to winches. For example, a rack-and-pinion mechanism could be used to drive a gantry to which the cutters are attached. The gantry can also include means by which to tilt and steer the excavator. The excavator can be attached to the gantry by lines, or it can be fixed to the gantry by bi-directional mechanical means. Such mechanical means may include a vertical actuation. In the former case, the downward forces will be generated solely by the weight of the excavator, but the lateral forces can be provided by means other than winches. In the latter case, the vertical force is provided by the combination of the weight of the excavator and the reaction force against the gantry assembly above the machine.

Calculations have been performed for the performance of the system shown in FIG. 21 utilizing the Bauer BC50 trench cutter:

Cutting depth: 2 m Cutting width: 0.84 m Rock production: 0.4 cu m/min Forward Speed: 0.25 m/min Assumed track length: 200 m Cycle time (per track): 800 m (13.3 hours)

The track length could be shortened or extended as appropriate for the topography. Many tracks should be possible to achieve with a single drag line/anchor placement, provided lateral guidance is provided.

Experience with trench cutters would suggest about a 16 hour cycle on changing out of teeth. This might argue for two units on separate hoist lines with one ready to commence a second pass when the first machine completes a pass and is retrieved.

The foregoing description is presented for purposes of illustration and description, and is not intended to limit the invention to the forms disclosed herein. Consequently, variations and modifications commensurate with the above disclosures and the disclosure of the relevant art are within the spirit of the invention. Such variations will readily suggest themselves to those skilled in the relevant art. Further, the examples described are also intended to explain the best mode for carrying out the invention, and to enable others skilled in the art to utilize the invention and such or other embodiments and with various modifications required by the particular applications or uses of the invention. It is intended that the appended claims be construed to include alternative embodiments to the extent that is permitted by prior art.

What is claimed is:

1. A subsea excavation apparatus comprising:
an excavator;
a first anchor in a fixed location on the seabed;
a first unidirectional subsea actuator attached to the excavator and the first anchor for converting power to mechanical force between the first anchor and the excavator;
a vertical actuator attached to the excavator and a surface platform for controlling force between the excavator and the surface platform;
wherein the first unidirectional subsea actuator exerts force in response to actuator control signals.

2. The subsea excavation apparatus of claim 1 wherein the vertical actuator comprises a motion compensated actuator.

3. The subsea excavation apparatus of claim 1 wherein the first unidirectional subsea actuator is attached directly to the excavator.

4. The subsea excavation apparatus of claim 1 wherein the first anchor is adapted to resist both horizontal and upward forces.

5. The subsea excavation apparatus of claim 1 wherein the first unidirectional subsea actuator is responsive to actuator control signals to manage the location of the excavator on an excavation face.

6. The subsea excavation apparatus of claim 1 wherein the excavator is responsive to excavator control signals and the excavator control signals and actuator control signals are provided interdependently to manage excavation location and rate.

7. A subsea excavation apparatus comprising:
an excavator;
a first anchor on the seabed;
a second anchor on the seabed;
a third anchor on the seabed;
a first unidirectional subsea actuator attached to the excavator and the first anchor for converting power to mechanical force between the first anchor and the excavator;
a second unidirectional subsea actuator attached to the excavator and the second anchor for converting power to mechanical force between the second anchor and the excavator;
a third unidirectional subsea actuator attached to the excavator and the third anchor for converting power to mechanical force between the third anchor and the excavator;
wherein the first, second, and third unidirectional subsea actuators exert force in response to actuator control signals.

8. The subsea excavation apparatus of claim 7 wherein the first, second, and third unidirectional subsea actuators are responsive to actuator control signals to manage the location of the excavator on an excavation face in three dimensions.

9. A method for controlling a subsea excavator comprising:
providing a first anchor on the seabed;
providing at least one unidirectional subsea actuator;
providing power to at least one unidirectional subsea actuator;
converting the power to at least one unidirectional subsea actuator to a mechanical force with at least one unidirectional subsea actuator;
applying the mechanical force from at least one unidirectional subsea actuator between the unidirectional subsea excavator and the first anchor;
providing a vertical actuator;
providing power to the vertical actuator;
converting the power to the vertical actuator to a mechanical force with the vertical actuator;
using the mechanical force from the vertical actuator to control force between the excavator and a surface platform;
providing actuator control signals to the at least one unidirectional subsea actuator and the vertical actuator.

10. The method for controlling a subsea excavator of claim 9 wherein the actuator control signals control the force exerted by the at least one unidirectional subsea actuator.

11. The method for controlling a subsea excavator of claim 9 wherein the actuator control signals are used to manage the location of the excavator on an excavation face.

12. The method for controlling a subsea excavator of claim 9 further comprising: providing excavator control signals to the excavator.

13. The method for controlling a subsea excavator of claim 9 wherein the power is provided by a surface platform.

14. The method for controlling a subsea excavator of claim 9 wherein the at least one subsea actuator applies mechanical force in a primarily horizontal direction.

15. The method for controlling a subsea excavator of claim 9 wherein:

the first anchor is adapted to resist both horizontal and upward forces; and the vertical actuator comprises a motion compensated actuator.

* * * * *